United States Patent [19]

Waters et al.

[11] Patent Number: 4,669,136

[45] Date of Patent: Jun. 2, 1987

[54] COMBINATION HOSPITAL BED AND SURGICAL TABLE

[75] Inventors: Jean B. Waters, Augusta; Alton F. Garrison, Evans; Richard C. Treat, Augusta, all of Ga.

[73] Assignee: Med-Con of Georgia, Inc., Martinez, Ga.

[21] Appl. No.: 719,205

[22] Filed: Apr. 2, 1985

[51] Int. Cl.[4] ..... A61G 7/06

[52] U.S. Cl. ..... 5/66; 5/69; 5/181; 5/185

[58] Field of Search ..... 5/60–66, 5/81 B, 69, 174–176 R, 181, 185; 108/27, 77; 269/322–325, 328

[56] References Cited

U.S. PATENT DOCUMENTS

| | | | |
|---|---|---|---|
| 2,092,266 | 9/1937 | Talas | 269/322 |
| 2,168,649 | 8/1939 | Johnson | 5/69 |
| 2,830,304 | 4/1958 | Ericsson | 5/63 |
| 2,831,200 | 4/1958 | Olsen | 5/69 |
| 3,036,314 | 5/1962 | Wetzler . | |
| 3,065,344 | 11/1962 | Chervenka | 269/325 |
| 3,304,116 | 2/1967 | Stryker . | |
| 3,327,328 | 6/1967 | Slivoski | 5/181 |
| 3,339,913 | 9/1967 | Anderson | 269/320 |
| 3,344,445 | 10/1967 | Crawford | 5/81 B |
| 3,503,082 | 3/1970 | Kerwit . | |
| 3,722,010 | 3/1973 | Saternus . | |
| 3,932,903 | 1/1976 | Adams et al. . | |
| 3,972,081 | 8/1976 | Stern et al. | 5/60 |
| 4,038,709 | 8/1977 | Kerwit . | |
| 4,287,620 | 9/1981 | Zur . | |
| 4,425,673 | 1/1984 | Werner . | |
| 4,435,862 | 3/1984 | King et al. | 5/60 |
| 4,489,449 | 12/1984 | Failor et al. | 5/62 |

FOREIGN PATENT DOCUMENTS

| | | | |
|---|---|---|---|
| 183181 | 7/1922 | United Kingdom | 5/181 |

OTHER PUBLICATIONS

Jorgensen et al, "Operating Table Controlling Water Balance and Temperature of Cats", IEEE Transactions on Biomedical Engineering, pp. 246–247, May 1972.

*Primary Examiner*—Gary L. Smith
*Assistant Examiner*—Michael F. Trettel
*Attorney, Agent, or Firm*—Sutherland, Asbill & Brennan

[57] ABSTRACT

A combination hospital bed and surgical table is disclosed. It is comprised of:

a frame having floor-engaging wheels, a substantially flat, substantially rectangular deck carried by the frame, suitable for holding a human patient in the supine position, the deck having a head end and a foot end and being divided into at least three sections, including a lengthwise center section bordered by two, opposite, lengthwise, side sections that are hingedly connected to the frame so that they each can swing from a horizontal position down to an underneath position, below the center section, thereby making the deck narrower to facilitate its use as a surgical table, and means for holding the side sections in their horizontal position.

Preferred additional features include means for raising and lowering the deck to different heights, a drop leaf head support segment, built-in weighing means, channels underneath the bed surface for X-ray cassettes, and an articulated bed surface to permit the bed to be converted into Trendelenburg, reverse Trendelenburg, or other positions, even a sitting position.

24 Claims, 10 Drawing Figures

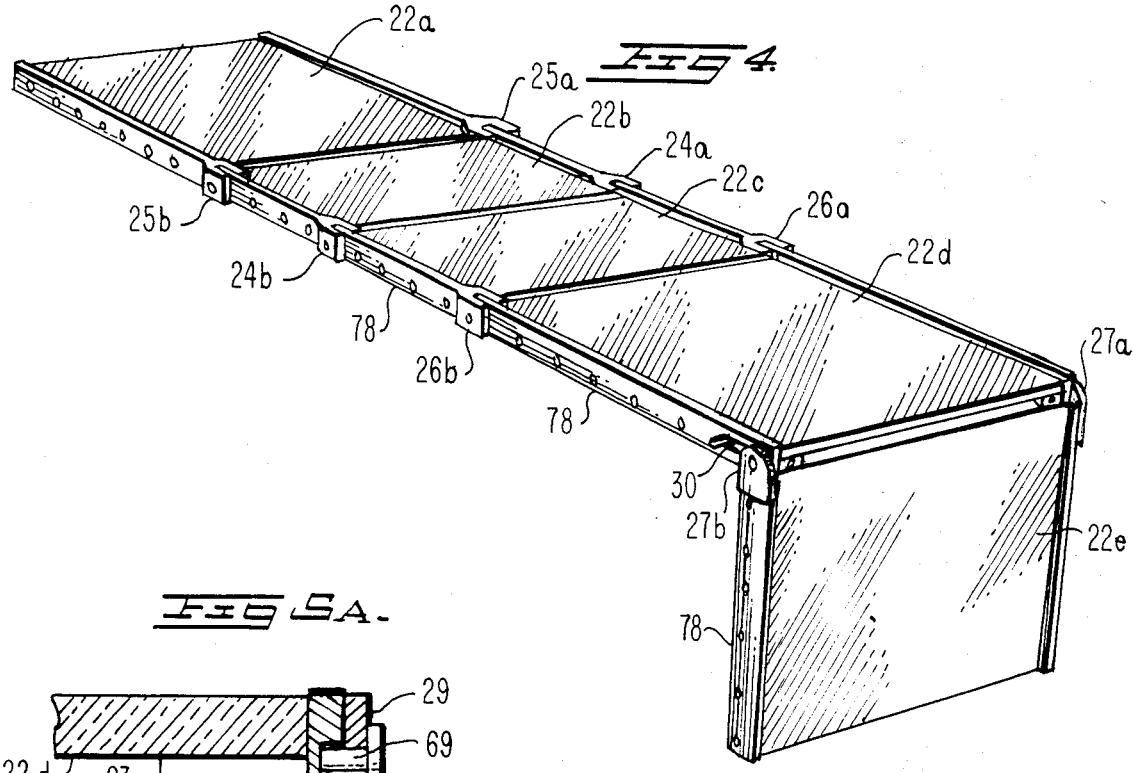
Fig 4.
Fig 5A.
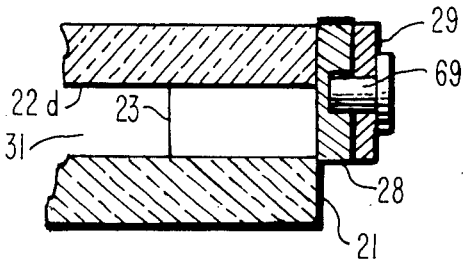
Fig 5.
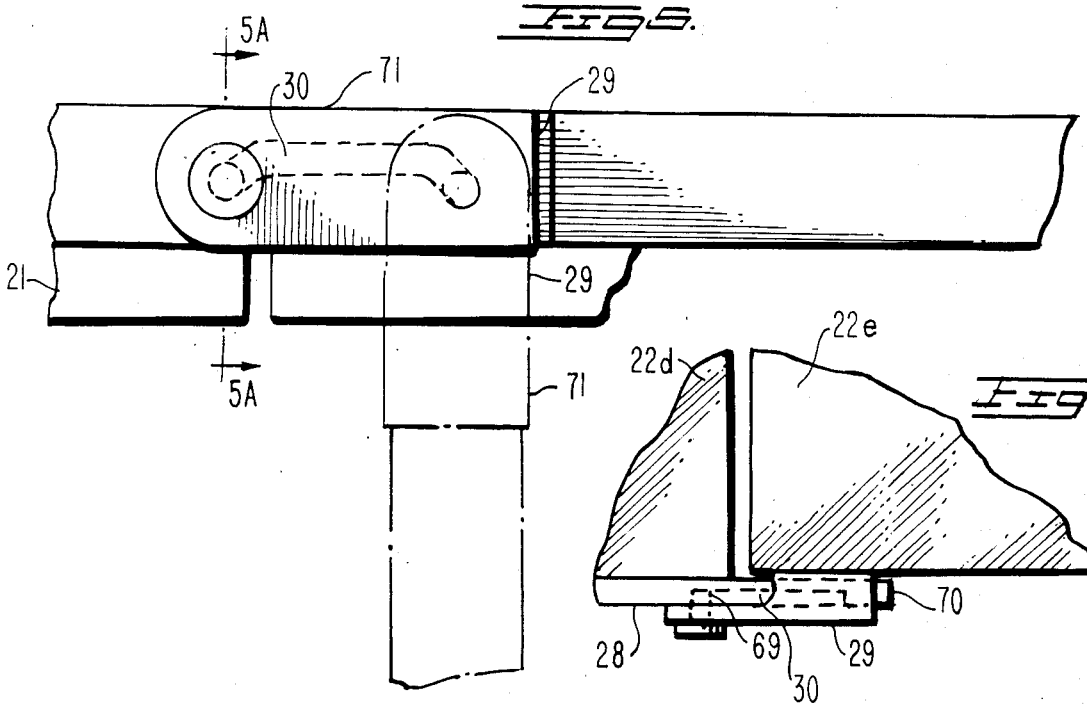
Fig 5B.

COMBINATION HOSPITAL BED AND SURGICAL TABLE

This invention relates to a combination hospital bed and surgical table, designed especially for use in the care of severely traumatized patients.

The care and treatment of severely traumatized patients frequently requires repeated transfers from a bed to a surgical, X-ray, or flouroscopy table. In addition to being time-consuming, such transfers often are painful for the patient and can give rise to aggravation of internal injuries. As a solution to this problem, we have invented an apparatus that can function both as a bed and as a surgical table, and can be converted from one to the other, without moving the patient. Moreover, in its preferred embodiment our apparatus also can function as an X-ray table and a flouroscopy table.

Our combination hospital bed and surgical table is comprised of a frame having floor-engaging wheels and a substantially flat, substantially rectangular deck carried by the frame, suitable for holding a human patient in the supine position. The deck has a head end and a foot end and is divided into at least three sections. These include a lengthwise center section bordered by two, opposite, lengthwise, side sections. Each side section is hingedly connected to the frame so that it can swing from a horizontal position, in which it forms part of the deck, down to an underneath position, in which it is stored below the center section, thereby making the deck narrower. Preferably, a collapsible side rail is mounted on each side section of the deck.

The normal width of a hospital bed is approximately 32 to 36 inches. A surgical table, however, needs to be narrower, to give the physician better access to the patient. The standard width of a surgical table is about 27 to 28 inches. By virtue of having the drop down side section, our apparatus can be used either as a bed or as a surgical table. Means are included in the bed/table for holding the side sections in their horizontal position. Preferably, these will be operable to releasably lock the side and center sections together. Separate mattress pads are preferably used on top of the center and side sections. The side mattress pads can be releasably attached to the deck so that they will not fall to the floor when the side sections are swung down.

Our bed/table preferably is equipped with means for raising and lowering the deck and holding it at a plurality of different heights. Ideally, these means will be operable to raise or lower the head end and the foot end independently of one another. In this manner, the deck may be placed in either the Trendelenburg or reverse Trendelenburg positions.

In a preferred embodiment the frame of the bed/table is comprised of a base portion on which the floor-engaging wheels are mounted, and, spaced apart from the base portion, a substantially parallel upper portion, on which the deck is mounted. In this arrangement the means for raising and lowering the deck can include two hydraulic lifting columns that connect the base and upper portions of the frame. These columns are preferably located on the longitudinal center line of the bed/table. Preferably, the lifting columns are operable to raise the upper portion of the frame to a height of at least about 29 inches above the base portion. This is to give enough clearance to permit flouroscoping of a patient lying on the bed/table by use of a C-arm flouroscope. (For this utility it is necessary that the center section of the deck be made of a radio-transluscent material.) To permit the lifting columns to operate independently, they both should be pivotally attached to the upper portion of the frame, and one of the columns should also be pivotally attached to the base portion of the frame. The other column, however, needs to be inflexibly attached to the base portion. The pivotal attachments need only provide freedom of movement in the vertical plane that runs through the longitudinal axis of the bed/table.

To permit the use of the bed/table as an X-ray table, channel means may be included for receiving and holding one or more X-ray cassettes underneath and parallel to the center section of the upper surface of the deck. It is required, of course, that the center section be made of radio-translucent material, e.g., polycarbonate resin, in order to function as an X-ray table.

Because it has wheels, our combination bed and table can function as a wheeled stretcher in an emergency room. Preferably, the wheels will be caster wheels and will have means for locking them against swiveling and means for locking them against rolling. A handlebar is preverably mounted on the foot end of the bed. It is also preferred, however, that the bed/table be equipped with at least four retractable legs that are operable to elevate the frame sufficiently to raise the wheels off the floor and hold the frame in that position. This serves to steady the apparatus when it is being used as a surgical table. Preferably, the legs are hydraulically operated.

To enable our apparatus to function best as a hospital bed, the center section of the deck may be articulated, so that it may be placed in a variety of positions that will elevate a supine patient's knees or shoulders, or both. Thus, the center section may be comprised of four, rectangular, side-by-side segments—an upper torso segment, a buttocks segment, an upper leg segment, and a lower leg segment. These may be hingedly joined together along three axes that are substantially perpendicular to the long dimension of the bed/table. Preferably the buttocks segment is rigidly attached to the frame. The joint between the lower leg and upper leg segments and the joint between the upper leg and buttocks segments together permit the deck to be flexed upward at about the location where a patient's knees would be. The joint between the buttocks and upper torso segments permits the upper torso segment to be tilted upwards to elevate a patient's back and shoulders. Means are required for flexing the center section of the deck at all three axes and for holding the section in a plurality of different positions.

With the articulated deck feature, if the bed/table also is equipped with means for independently raising and lowering the head and foot of the upper portion of the frame, the patient can practically be brought to a full sitting position. This is accomplished by raising the head end of the frame as high as possible, while keeping the foot end at its lowest position, tilting up the upper torso segment as high as it will go, and also flexing the deck's center section where the upper and lower leg segments are hinged together.

In some surgical procedures involving the head or neck, a restraint must be used to prevent the head from moving. It is frequently called a "neurological head rest." To enable our apparatus to be used as a surgical table for such procedures, we prefer to include a fifth segment in the center section of the deck—namely, a head segment. The head segment is hingedly connected to the upper torso segment along a fourth axis that also is substantially perpendicular to the long dimension of the bed/table. The connection between the head segment and upper torso segment permits the head segment to be either locked in a coplanar position with the upper torso segment or swung down to a substantially vertical position below the level of the deck. In other words, the head segment functions much like the drop leaf of a table. Preferably, the frame of the bed/table also will carry means for attaching head restraint equipment to the apparatus when the head segment is in the down position.

Another preferred feature of our bed/table is the inclusion of means mounted on the frame for weighing a person or object resting on the deck. Burn victims, for example, sometimes need to be weighed periodically to monitor their fluid gain or loss. It can be especially painful for a burn victim to be moved from his bed to a scale, and then back again. The weighing means for our apparatus can include a plurality of stress gauges carried by the frame so as to support substantially the entire weight of the center section of the deck, plus whatever is resting on it. By subtracting the weight of the bed empty (the tare weight) from its weight when occupied, the weight of the patient is determined. Ideally, this calculation is done by a microprocessor located, for example, in the base portion of the frame. Means associated with each of the stress gauges generate an electronic signal which is indicative of the weight being measured by the gauge. The microprocessor receives the signals from all of the gauges and, in response thereto, generates an output signal that corresponds to the sum of those signals. The output signal is sent to numeric display means which use the signal to create a visual read-out of the weight of the person or object resting on the deck. In a preferred embodiment, the microprocessor is operable to calculate the weight either in avordupois pounds or kilograms, and the bed/table includes microprocessor control means for choosing among the possible functions of the microprocessor. It is useful to have a read-out in kilograms in instances where medication must be administered by infusion and the prescribed dosage is given in milligrams per kilogram of body weight.

Another function the microprocessor may advantageously be equipped with is that of a timer which can count down by seconds. The display means then should be operable to visually display the progress of the countdown and to generate an audible signal when the countdown is concluded. This is a useful feature when, for example, the medication must be administered by intravenous infusion for a certain number of seconds or minutes.

The preferred means for flexing the center section of the deck is one or more hydraulic pistons carried by the frame and attached to the underside of the upper torso segment of the center section, as well as one or more other hydraulic pistons carried by the frame and attached to the underside of the lower leg segment. Preferably, these pistons and the hydraulic lifting columns all will be connected to a common sump. Mechanical control means can be provided for releasing the hydraulic fluid from all of the pistons and the lifting columns in one quick motion, thereby allowing the fluid to drain into the sump and causing the deck to be returned to its lowermost flat position. This is a useful feature in case the patient goes into cardiac arrest. Hydraulic pistons normally move rather deliberately and slowly. If the bed is elevated and the deck is articulated at the onset of the cardiac arrest, precious time could be lost bringing the patient to a lower flat position where he could be administered to by difibrillator or the like. This feature allows all the pistons and lifting columns to be drained in one quick motion, swiftly bringing the deck to a flat position at its lowest elevation.

If hydraulically operated, the bed/table preferably will include an electric pump to drive the hydraulic system, with hydraulic control means associated therewith. The control means should be operable to independently control (a) the retractable legs, (b) the piston or pistons attached to the upper torso segment of the deck, (c) the piston or pistons attached to the lower leg segment of the deck, (d) the lifting column that is pivotally attached to the base portion of the frame, and (e) the lifting column that is inflexibly attached to the base portion of the frame.

Preferably, a single housing will be provided to contain the switching means for the hydraulic controls and microprocessor controls, as well as to contain the display means that is driven by the microprocessor. These switching and display means may all be packaged in a hand-held housing attached to the end of an electrical cable. Means may be mounted on the frame for holding the housing when it is not in use.

It is also preferred that there be means carried by the frame of the bed/table for attaching orthopedic hardware or intravenous equipment to it. These are usually female fittings designed to receive and tightly hold round rods or poles.

Our invention will be better understood by studying the drawings accompanying this specification, which depict a preferred embodiment of the invention. Referring to the drawings, FIG. 1 is a side elevation view of the bed/table;

FIG. 4 is a perspective view of the hinged deck segments of the bed/table;

FIG. 5 is an enlarged detailed view of the connection between the head and upper torso segments of the center section of the deck;

FIG. 5A is an enlarged fragmentary vertical sectional view along line 5A—5A of FIG. 5.

FIG. 5B is a fragmentary detailed view of the hinged connection between the upper torso and head sections of the deck.

Figure 1:
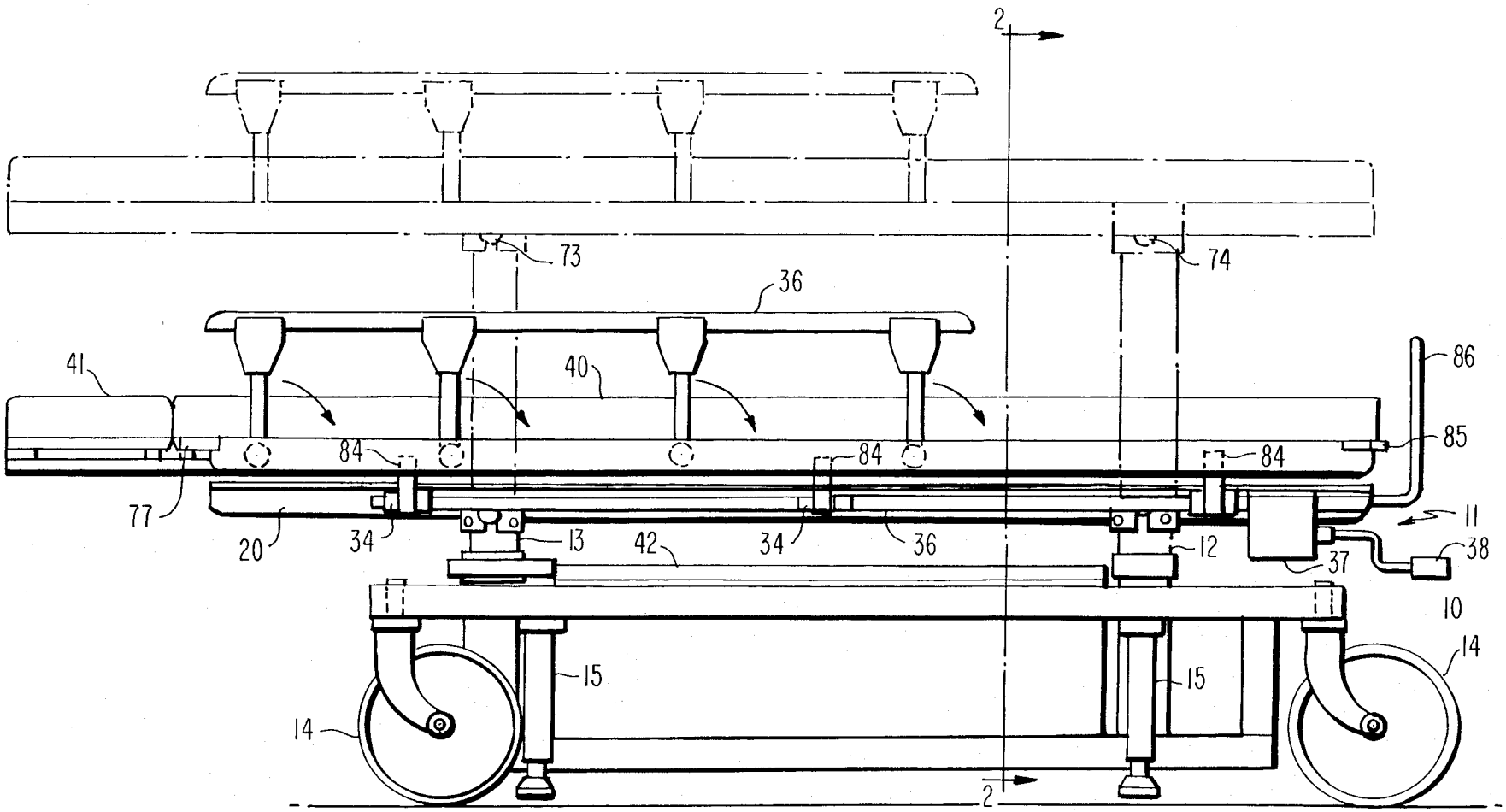

The frame for the bed/table is comprised of a base portion 10 and an upper portion 11. Upper portion 11 is supported above base portion 10 by hydraulically operated, telescopic lifting columns 12 and 13. Both columns are pivotally joined at their upper ends to upper portion 11 of the frame, by pivot pins 73, 74, 75 and 76. Foot end lifting column 12 is also pivotally connected to the base portion 10 of the frame by pivot pin 72. Head end lifting column 13 is inflexibly attached to base portion 10. In this manner, the two lifting columns 12 and 13 may be independently raised and lowered. When they are at different heights, foot end column 12 leans toward column 13, as illustrated, for example, in FIG. 6.

The frame is mounted on four floor-engaging caster wheels 14. Each wheel has conventional means (not shown in the drawings) to lock it against swiveling and to brake it against turning.

Figure 2:
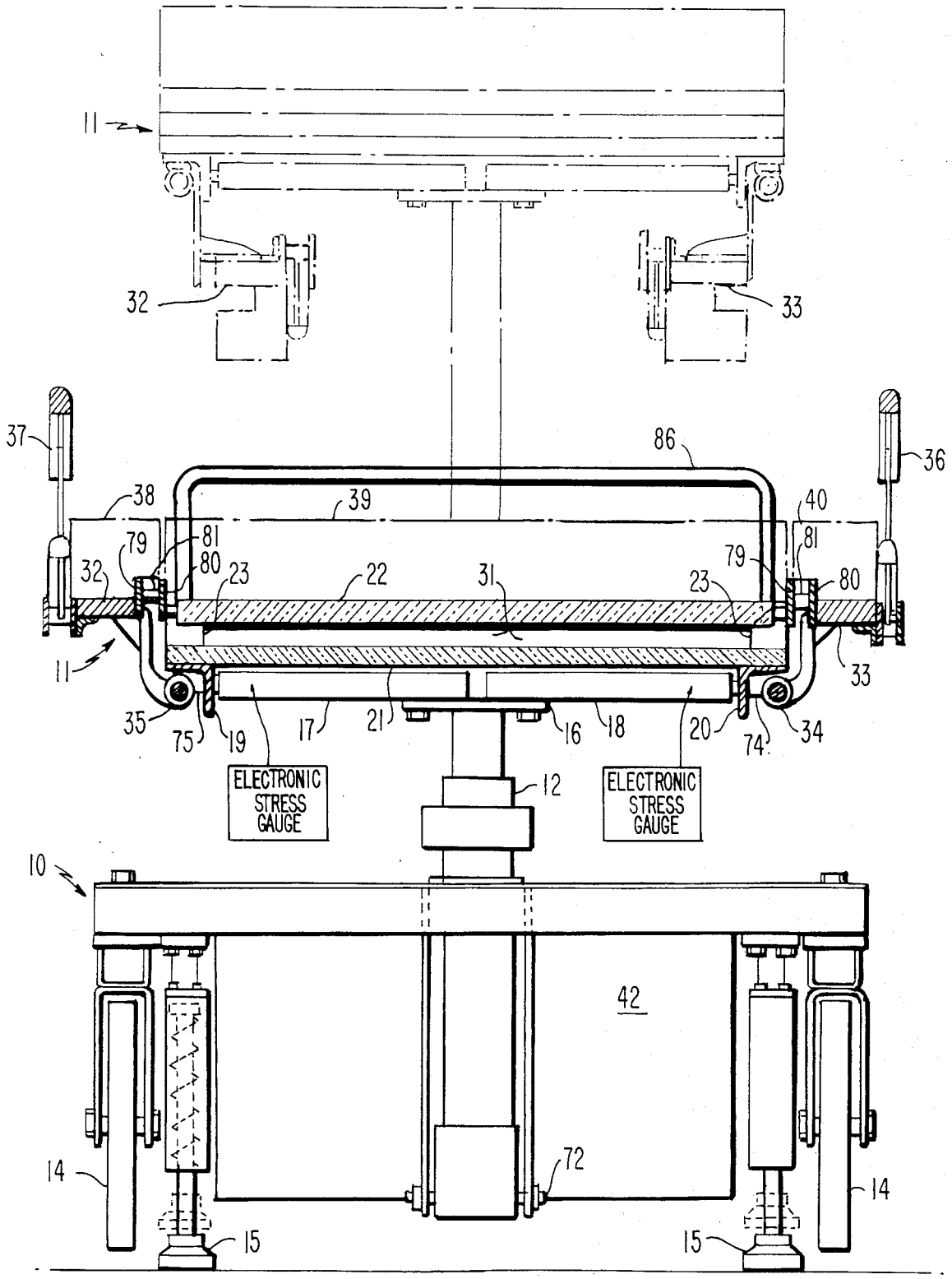
FIG. 2 is a transverse section view taken along the line 2—2 of FIG. 1.
Figure 6:
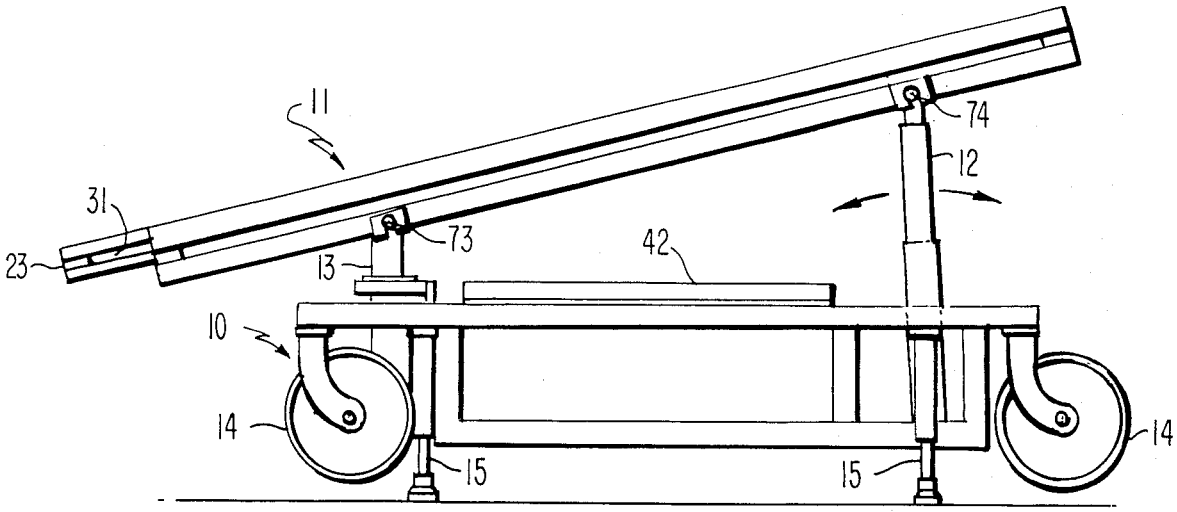
FIG. 6 is a schematic view of the bed/table in the Trendelenburg position.
Figure 7:
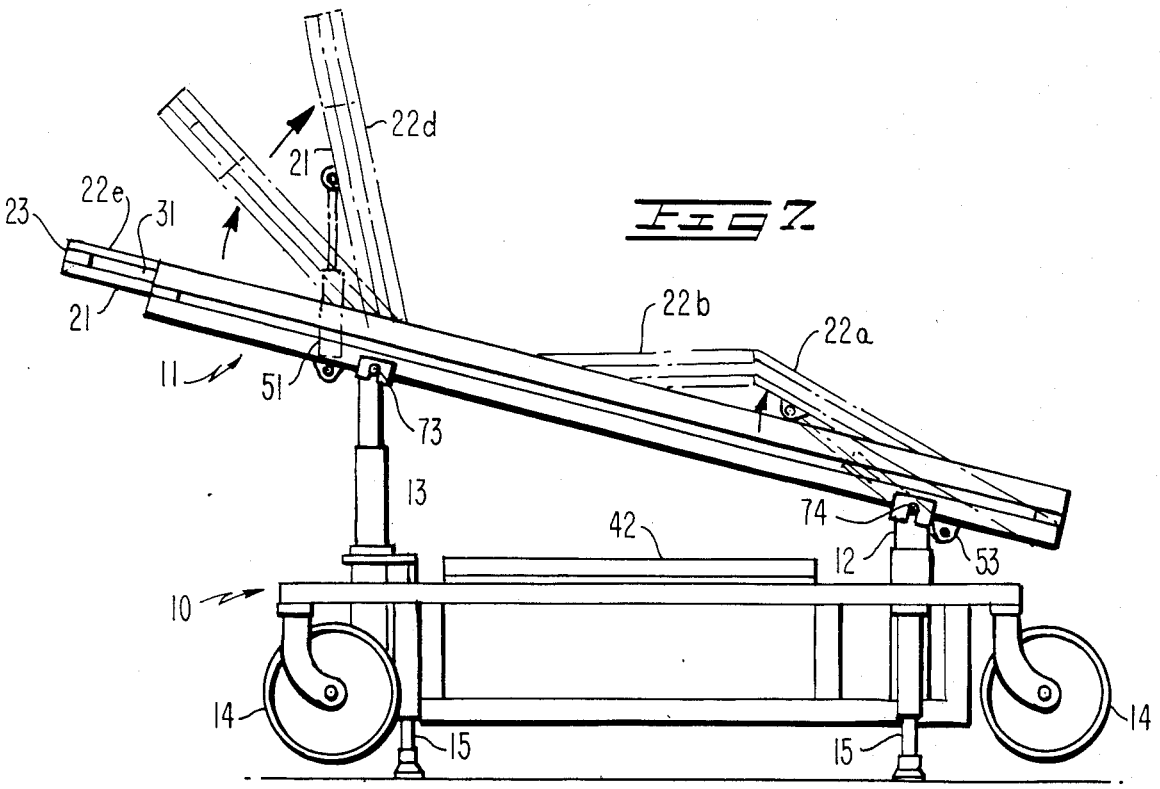
FIG. 7 is a schematic view of the bed/table in the reverse Trendelenburg position.

Four hydraulically operated, retractable legs 15 are mounted on the underside of base 10. As illustrated in FIGS. 2, 6, and 7, legs 15 may be lowered far enough to elevate wheels 14 off the floor. This gives the apparatus additional stability when it is used as a surgical table.

Fixed to the upper end of lifting column 12 is top plate 16, which is bolted to two horizontal arms 17 and 18, which have conventional, electrically driven stress gauges (not shown) inside them. These arms end in pivot pins 75 and 74, respectively, and support rails 19 and 20 of the upper portion 11 of the frame. As the weight upon the upper portion 11 of the frame is increased, it exerts a greater downward force on rails 19 and 20, and they in turn exert a downward bending force on arms 17 and 18. The amount of such bending force is measured by the stress gauges inside the arms. Identical arms 61 and 62 (see FIG. 8) are mounted on top of lifting column 13.

Laying atop rails 19 and 20 is a double thickness deck center section made of polycarbonate slabs 21 and 22, which are held together by spacer blocks 23. In FIG. 4 the center section is shown alone. As illustrated there the center section consists of five segments: a lower leg segment 22*a*, an upper leg segment 22*b*, a buttocks segment 22*c*, an upper torso segment 22*d*, and a head segment 22*e*. Buttocks segment 22*c* is immovably attached to the upper portion 11 of the frame. Upper leg segment 22*b* is pivotally connected to buttocks section 22*c* by hinges 24*a* and 24*b*. Lower leg segment 22*a* and upper leg segment 22*b* are pivotally joined together by hinges 25*a* and 25*b*. In this manner, the center section can be flexed upwards at the axis of hinges 25*a* and *b*, which is approximately the location where a patient's knees would be when lying on the bed/table in a supine position.

Upper torso segment 22*d* of the center section is pivotally joined to buttocks segment 22*c* by hinges 26*a* and 26*b*. This arrangement permits upper torso segment 22*d* to be tilted up to elevate a patient's back and shoulders.

Head segment 22*e* is connected to upper torso segment 22*d* by a pair of drop-leaf hinges 27*a* and 27*b*. Hinge 27*b* consists of a female member 28 fastened to upper torso segment 22*d*, and a male member 29 fastened to head segment 22*e*. Female member 28 has a horizontal slot 30 in it, which has downturned ends. Male member 29 has an inwardly projecting lug 69 that rides inside slot 30, thus linking the members 28 and 29 together. Behind lug 69, male member 29 is folded over to form a channel into which the distal end 70 of female member 28 slides when head segment 22*e* is locked into coplanar engagement with upper torso segment 22*d*, as shown in solid lines in FIG. 5 and in FIG. 5B. In this position the top edge 71 of male member 29 prevents head segment 22*e* from swinging down. Looking at FIG. 5, it can be seen that in order to lower head segment 22*e*, it first must be pulled to the right, while kept horizontal, thereby moving lug 69 from the left end of slot 30 to the right end thereof. That movement disengages top edge 71 of male member 29 from the top edge of female member 28, and permits segment 22*e* to be swung down into the position shown in broken lines in FIG. 5.

The purpose of designing head segment 22*e* so that it can be dropped to a substantially vertical position is to permit the attachment of standard head restraint gear (not shown) to the bed/table. For this purpose, upper portion 11 of the frame is preferably equipped with conventional female fittings 77 (see FIG. 1), one on each side of the the bed/table, for receiving and holding such equipment.

Spacer blocks 23 provide a channel 31 between slabs 21 and 22 of the center section of the deck. Channel 31 is provided in all five segments, 22*a*, 22*b*, 22*c*, 22*d*, and 22*e*. Channel 31 will receive X-ray cassettes (not shown), thereby permitting the apparatus to be used as an X-ray table, without disturbing the patient.

As illustrated in FIGS. 1 and 2, lifting columns 12 and 13 may be activated to raise upper portion 11 of the frame to a substantial height above the base portion 10, e.g., providing a clearance of about 29 to 30 inches. (The broken line drawing shows upper portion 11 at its fully raised position; the solid line drawing shows it fully lowered.) This permits the use of a C-arm flouroscope (not shown) to examine most parts of the body of a patient lying on the bed/table.

Figure 3:
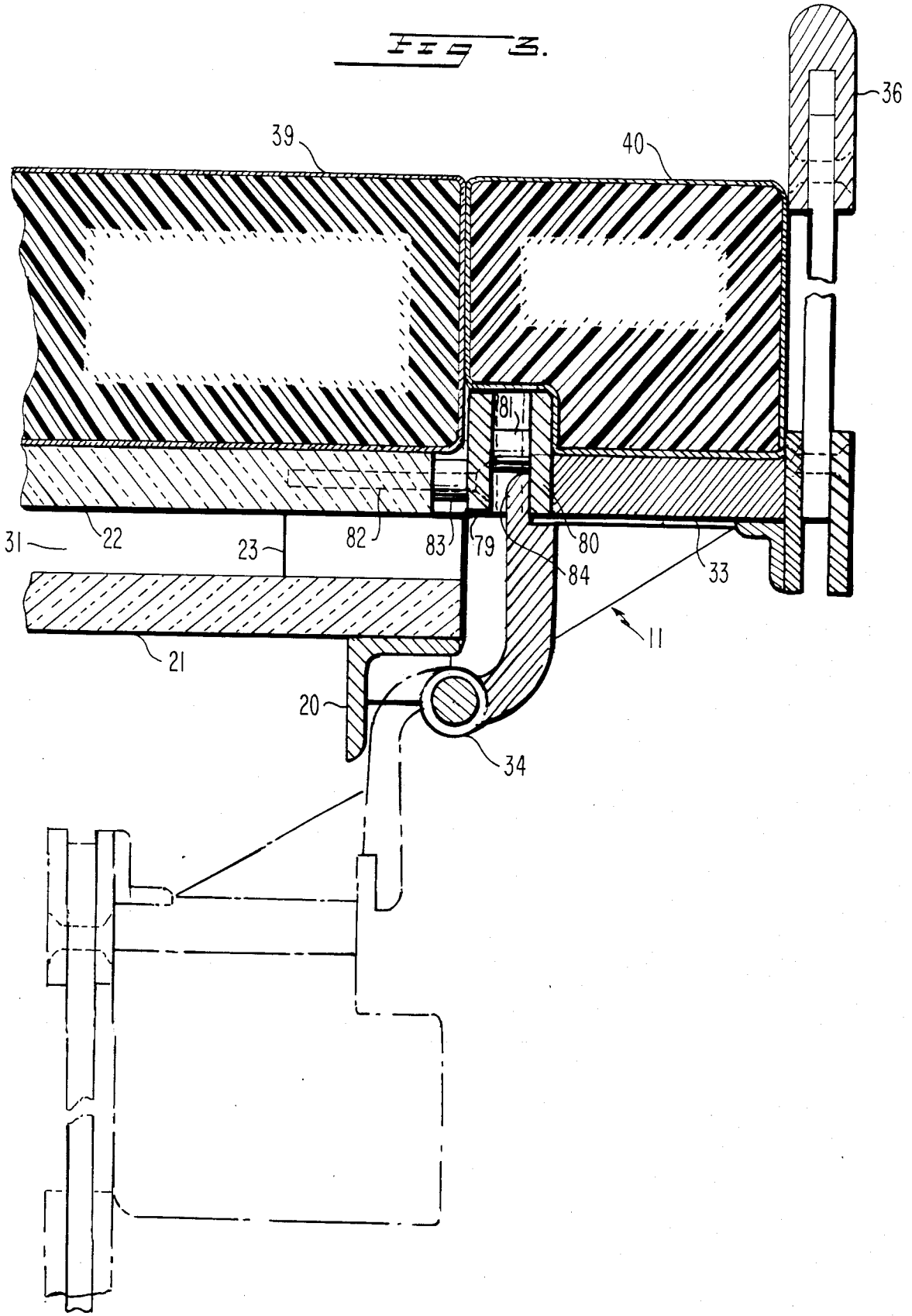
FIG. 3 is an enlarged detailed sectional view of the righthand side section of FIG. 2.

Mounted along each side of the center section of the deck are side sections 32 and 33. These are pivotally connected to upper frame 11 by hinges 34 and 35. In FIGS. 2 and 3 side sections 32 and 33 are shown in solid lines in their raised positions, and in broken lines in their lowered positions. As shown in FIG. 1, hinges 34 are linked together by shaft 36 which is driven by gear box 37, which is manually operated by crank handle 38. The same arrangement (not shown) is provided on the opposite side of the bed/table with respect to hinges 35. Side sections 32 and 33 are not articulated and are not radiotranslucent. They may be made of wood and they extend the length of segments 22*a*, *b*, *c*, and *d* of the center section of the deck.

As shown in FIGS. 2, 3, and 4, there are mounted to both sides of each of the top polycarbonate slabs, 22*a–e*, metal edge members, shown generally as 78. Each member 78 is made up of parallel flat bars 79 and 80 that are joined together by spacer collars 81. Member 78 is held to polycarbonate slab 22 by screws 82 through bar 79. Spacer collars 83 provide room at the ends of member 78 to accommodate the greater width of hinges 25, 26, and 27. As illustrated in FIGS. 2 and 3, the size of edge members 78 is exaggerated, for purposes of clarity. As seen in FIG. 3, the space between bars 79 and 80 permits side section 33 to be locked to the center section of the deck when side section 33 is in its full upright position and the center section is flat, i.e., not flexed. To lock the two sections together, the side section must first be in a lowered, or partly lowered, position, and the center section must be at least partially flexed. Side section 33 is then cranked to its full upright position, which causes fingers 84, which are carried by hinges 34, to point upward. Each finger 84 is located near one of the hinges 24, 25, or 26, but not adjacent buttocks segment 22*c*, which is inflexible. The center section is then brought to its flat position by operation of pistons 51, 52, 53, and 54, causing edge members 78 to lower, coming astraddle of fingers 84. As seen in FIG. 3, this provides security against side section 33 bending down when weight is placed on the edge of the bed.

As shown in FIGS. 1, 2, and 3, a collapsible side rail 36 is mounted to side section 33, and an identical collapsible side rail 37 is mounted to side section 32. In FIG. 1 collapsible side rail 36 is shown in its upright position, both in the solid line view and in the broken line view. In FIG. 2 side rails 36 and 37 are shown in the solid line view in their upright position, but are shown in the broken line view in their collapsed position. Side rails 36 and 37 are equipped with means (not shown) for holding them in both positions.

FIGS. 1, 2, and 3 show the bed/table with mattress pads 38, 39, 40 and 41. Side section pads 38 and 40 are identical elongated pads that are releasably attached to side sections 32 and 33, so that, when the side sections are swung down to their lowered positions, pads 38 and 40 will not fall off. The means of attachment (not shown) may be Velcro-type fasteners. Velcro is a trademark for a hook-and-loop fabric fastener.

Center section pad 39 lays over top of deck segments 22*a, b, c,* and *d.* Head pad 41 lays atop head segment 22*e* and likewise may be releasably attached thereto so that pad 41 will not fall to the floor when head segment 22*e* is placed in its dropped position, as illustrated in FIG. 4.

As can be seen in FIG. 2, when side sections 32 and 33 are swung underneath upper frame 11, the width of the bed/table is substantially narrowed, facilitating its use as a surgical table.

Figure 8:
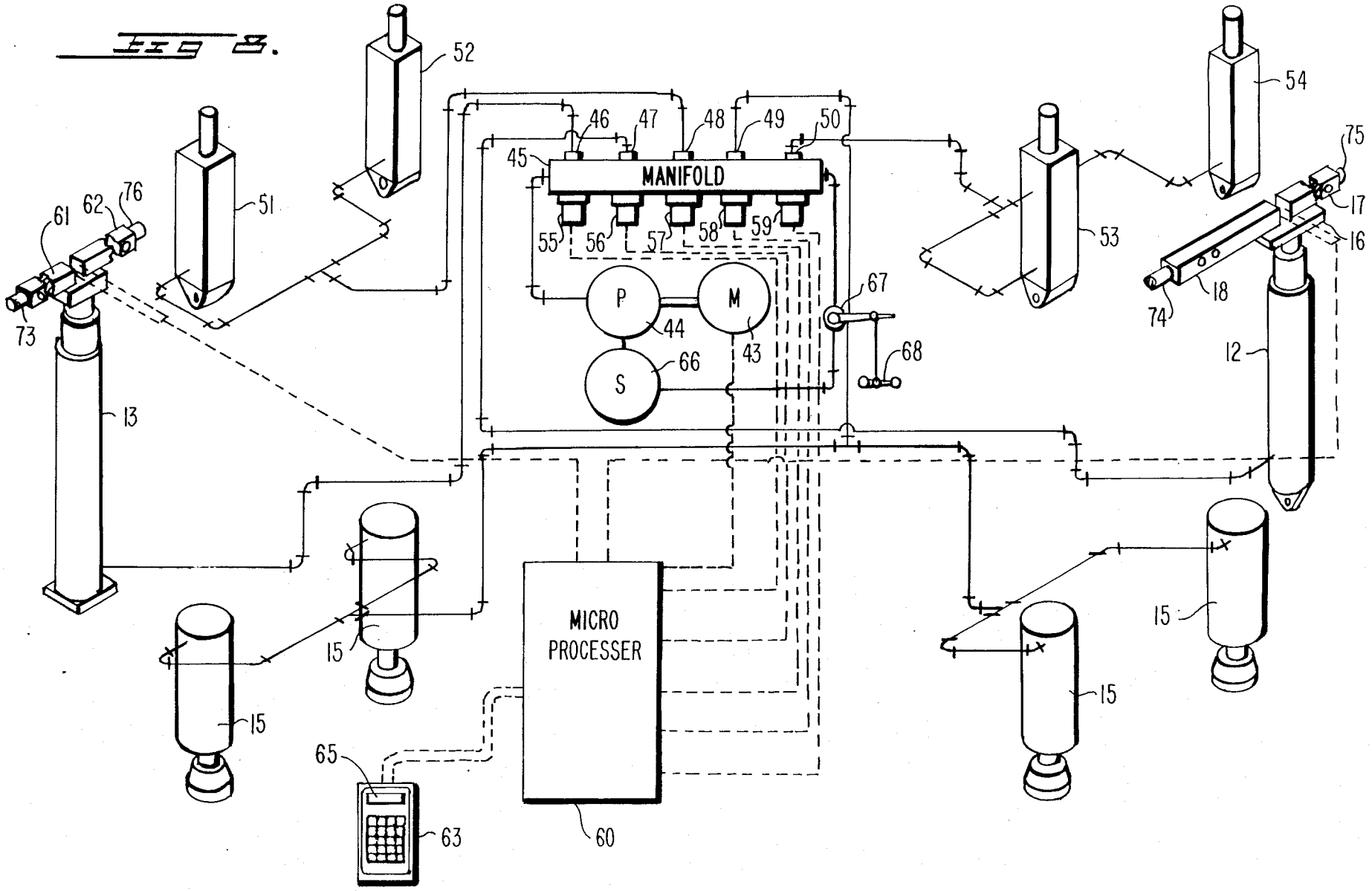
FIG. 8 is a combination hydraulic flow and wiring diagram of the bed/table.

Mounted on base portion 10 of the frame of the bed/table is housing 42, which holds the hydraulic pump 44, electric motor 43 and microprocessor that operate the bed/table. As illustrated in FIG. 8, the electric motor 43 drives pump 44 which is connected to hydraulic fluid manifold 45. Manifold 45 is equipped with ports 46, 47, 48, 49, and 50. The line from port 46 feeds hydraulic lifting column 13. The line from port 47 feeds lifting column 12. The line from port 48 feeds hydraulic pistons 51 and 52, which, as shown in FIG. 7, are pivotally mounted at their lower ends to the upper portion 11 of the frame, and are pivotally mounted at their upper ends to the polycarbonate slab section 21 that underlies upper torso segment 22*d* of the center section of the deck.

Port 49 is connected by a hydraulic line to all four retractable legs 15. Port 50 is connected by a hydraulic line to hydraulic pistons 53 and 54, which, as shown in FIG. 7, are pivotally connected at their lower ends to the upper portion 11 of the frame, and are pivotally connected at their upper ends to the panel of polycarbonate slab 23 that underlies lower leg segment 22*a.*

Manifold ports 46, 47, 48, 49, and 50 are equipped with valves (not shown) that are opened and closed by solenoid switches 55, 56, 57, 58, and 59, respectively. These switches are electrically connected to microprocessor 60. Also connected to microprocessor 60 are the stress gauges located inside bars 17, 18, 61, and 62. Hand-held control unit 63 is linked to microprocessor 60 via electrical cable 64. Unit 63 has push button control means to operate microprocessor 60 and open and close any of the solenoid switches 55, 56, 57, 58, or 59. Unit 63 is equipped with display means 65 for indicating the combined weight resting on the stress gauges in bars 17, 18, 61 and 62. Microprocessor 60 operates to receive electrical impulses from all four stress gauges, process the information, and generate an output signal to LED display means 65 that reports the weight resting on the bed/table either in avoirdupois pounds or kilograms. Push button means are provided on unit 63 for selecting between pounds and kilograms.

Microprocessor 60 also is provided with a countdown timer function which alternatively may drive the display means 65 in unit 63. The timer function also may be selected by push button control means on unit 63.

Also contained in housing 42 on base portion 10 of the frame is sump 66, which is connected via hydraulic lines both to manifold 45 and pump 44. Between manifold 45 and sump 66 is a mechanical dump valve 67 which is linked to control lever 68, which is mounted on the base portion 10 of the frame, outside housing 42. Valve 67 normally will be in the closed position. One pull on lever 68, however, will open valve 67 and permit the hydraulic fluid in manifold 45 to drain into sump 66. This causes an immediate loss of pressure in pistons 51, 52, 53, and 54, in lifting columns 12 and 13, and in retractable legs 15. If any of those hydraulic units are in an extended position at the time lever 68 is pulled, they will immediately drop down, bringing the upper portion 11 of the frame to its lowermost position and making the center section of the deck flat. This feature is designed to give a medical team immediate access to the patient if he suffers cardiac arrest.

As shown in FIG. 1, the upper portion 11 of the frame of the bed/table has a female fitting 85 for receiving standard orthopedic equipment hardware, such as devices to put the patient in traction. Such fittings are preferably located at both the head end and foot end of the bed/table, one fitting at each corner. One or more additional fittings (not shown) are also preferably carried by upper frame portion 11 for holding an I.V. pole. A handle 86 is mounted to the foot end of the bed/table, to be grasped when pushing or pulling the apparatus from one location to another.

We claim:

1. A combination hospital bed and surgical table comprised of:

a frame having floor-engaging wheels;

an elongated, substantially rectangular deck carried by the frame, suitable for holding a human patient in the supine position, the deck having an upper surface and a lower surface, a head end and a foot end, and being divided into a lengthwise center section which can be placed in a flat, horizontal position and two, opposite, lengthwise, side sections that border the center section and are substantially coplanar therewith when the center section is in its flat, horizontal position, said side sections being hingedly connected to the frame so that each side section can independently swing from a horizontal position, in which they abut the center section and form part of the deck, down to an underneath position, in which it is stored below the center section, thereby making the deck narrower to facilitate its use as a surgical table, said center section of the deck being comprised of four rectangular segments joined end-to-end, the axes of said joints being substantially perpendicular to the long dimension of the deck, the segment at the head end of the deck (hereinafter the "upper torso segment") being hingedly joined to the adjacent segment (hereinafter the "buttocks segment") so that the head end of the upper torso segment can be tilted upwards, the segment at the foot end of the deck (hereinafter the "lower leg segment") being hingedly joined to the adjacent segment (hereinafter the "upper leg segment") and the upper leg segment being hingedly joined to the buttocks segment, so that the upper and lower leg segments can be flexed upwards where they are joined together;

means for holding the side sections in their horizontal position;

means for tilting upwards the upper torso segment and holding it tilted at different angles;

means for flexing upwards the upper and lower leg segments and holding them flexed at different heights; and means for raising and lowering the deck and holding it at different heights.

2. The combination hospital bed and surgical table of claim 1, wherein the means for raising and lowering the deck are operable to raise or lower the head end and the foot end independently of one another, so as to enable the deck to be placed in either the Trendelenburg or reverse Trendelenburg positions.

3. The combination hospital bed and surgical table of claim 2, wherein the center section of the deck additionally comprises a rectangular head segment that is hingedly connected to the upper torso segment along a fourth axis that also is substantially perpendicular to the long dimension of the bed/table, said connection serving to permit the head segment to be either locked in a coplanar position with the upper torso segment or swing down to a substantially vertical position below the level of the deck.

4. The combination hospital bed and surgical table of claim 3, wherein the center section of the deck is made of radio-transluscent material.

5. The combination hospital bed and surgical table of claim 4, further including channel means for receiving and holding one or more x-ray cassettes underneath and parallel to the upper surface of the deck.

6. The combination hospital bed and surgical table of claim 5, further including at least four retractable legs carried by the frame that are operable to elevate the frame sufficiently to raise the wheels off the floor and hold the frame in that position.

7. The combination hospital bed and surgical table of claim 6, wherein the retractable legs are hydraulically operated.

8. The combination hospital bed and surgical table of claim 7, further including means mounted on the frame for weighing a person or object resting on the deck.

9. The combination hospital bed and surgical table of claim 8, wherein the weighing means includes a plurality of cross beams carried by the frame, which cross beams support substantially the entire weight of the center section plus whatever is resting on it, each of said cross beams carrying a stress gauge adapted to measure the weight supported by the beam.

10. The combination hospital bed and surgical table of claim 9, further including means carried by the frame for attaching intravenous equipment to the bed/table.

11. The combination hospital bed and surgical table of claim 10, further including means carried by the frame for attaching orthopedic equipment to the bed/table.

12. The combination hospital bed and surgical table of claim 11, further including means carried by the frame for attaching head restraint equipment to the bed/table when the head segment of the deck is in the down position.

13. The combination hospital bed and surgical table of claim 12, wherein the frame comprises a base portion on which the floor-engaging wheels are mounted, and, spaced apart from the base portion, a substantially parallel upper portion, on which the deck is mounted, and the means for raising and lowering the deck includes two hydraulic lifting columns that connect the base and upper portions of the frame and which are located on the longitudinal center line of the bed/table, said columns being operable to raise the upper portion of the frame to a height of at least about 29 inches above the base portion, so as to permit fluoroscoping of a patient lying on the bed/table by use of a C-arm fluoroscope.

14. The combination hospital bed and surgical table of claim 13, further including a collapsible side rail mounted on each side section of the deck.

15. The combination hospital bed and surgical table of claim 14, wherein the weighing means includes means associated with each of the stress gauges for generating an electronic signal indicative of the weight being measured by the gauge, microprocessor means for receiving all of said electronic signals and, in response thereto, generating an output signal corresponding to the sum of said signals, and numeric display means for receiving said output signal and using it to create a visual readout of the weight of a person or object resting on the deck.

16. The combination hospital bed and surgical table of claim 15, wherein the microprocessor means is operable to generate an output signal indicative of the weight of a person or object resting on the deck, which is expressed either in kilograms or in avoirdupois pounds, and the bed/table further includes microprocessor control means for choosing among the possible functions of the microprocessor.

17. The combination hospital bed and surgical table of claim 16, wherein the microprocessor means also has a timer function which can count down by seconds, and the display means is operable to visually display the progress of the countdown and to generate an audible signal when the countdown is concluded.

18. The combination hospital bed and surgical table of claim 17, wherein the means for tilting upwards the upper torso segment of the center section of the deck includes at least one hydraulic piston carried by the frame and pivotally attached to the underside of the upper torso segment of the center section, and the means for flexing upwards the upper and lower leg segments of the center section of the deck includes at least one hydraulic piston carried by the frame and pivotally attached to the underside of the lower leg segment.

19. The combination hospital bed and surgical table of claim 18, wherein the hydraulic pistons and the hydraulic lifting columns all are connected to a common sump, and the bed/table futher includes mechanical control means for releasing the hydraulic fluid from all of said pistons and lifting columns in one quick motion, thereby allowing the fluid to drain into the sump, causing the deck to return to its lowermost flat position.

20. The combination hospital bed and surgical table of claim 19, wherein each of the lifting columns is pivotally attached to the upper portion of the frame, one of the columns is pivotally attached to the base portion of the frame, and the second column is inflexibly attached to the base portion of the frame.

21. The combination hospital bed and surgical table of claim 20, further including an electric pump, with hydraulic control means associated therewith, for operating the retractable legs, the hydraulic pistons, and the hydraulic lifting columns, said hydraulic control means being operable to independently control (a) the retractable legs, (b) the piston pivotally attached to the upper torso segment of the deck, (c) the piston pivotally attached to the lower leg portion of the deck, (d) the lifting column that is pivotally attached to the base portion of the frame, and (e) the lifting column that is inflexibly attached to the base portion of the frame.

22. The combination hospital bed and surgical table of claim 21, further including a single housing in which are contained switching means for the hydraulic control means, switching means for the microprocessor control means, and the display means that is driven by the microprocessor.

23. The combination hospital bed and surgical table of claim 22, wherein the housing is a hand-held device attached to the end of an electrical cable, and the bed/table further includes means mounted on the frame for holding the device when it is not in use.

24. The combination hospital bed and surgical table of claim 23, wherein the floor-engaging wheels are caster wheels.

* * * * *